US008262428B2

(12) United States Patent
Lesch et al.

(10) Patent No.: US 8,262,428 B2
(45) Date of Patent: Sep. 11, 2012

(54) METHOD FOR MANUFACTURING A DOUBLE TUBE DISCHARGE LAMP

(75) Inventors: Norbert Lesch, Vaals (NL); Jozef Merx, Vaals (NL); Gerald Scholak, Baesweiler (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 441 days.

(21) Appl. No.: 12/097,944

(22) PCT Filed: Dec. 13, 2006

(86) PCT No.: PCT/IB2006/054793

§ 371 (c)(1),
(2), (4) Date: Jun. 18, 2008

(87) PCT Pub. No.: WO2007/072312

PCT Pub. Date: Jun. 28, 2007

(65) Prior Publication Data

US 2008/0261479 A1 Oct. 23, 2008

(30) Foreign Application Priority Data

Dec. 23, 2005 (EP) ..... 05112873

(51) Int. Cl.
*H01J 9/00* (2006.01)

(52) U.S. Cl. ..... 445/26; 313/623; 313/25

(58) Field of Classification Search ..... 313/17, 313/558, 623, 634, 25; 445/26
See application file for complete search history.

(56) References Cited

U.S. PATENT DOCUMENTS 3,870,919 A 3/1975 Hellman et al.
4,082,392 A * 4/1978 Golin ..... 445/26
4,221,989 A * 9/1980 Van Lieshout ..... 313/331
5,211,595 A 5/1993 Kowalczyk et al.
5,359,255 A * 10/1994 Kawai et al. ..... 313/17
5,532,543 A * 7/1996 Van Der Leeuw et al. ..... 313/25
6,026,671 A 2/2000 Battenfeld
2002/0063529 A1 5/2002 Fukai et al.

(Continued)

FOREIGN PATENT DOCUMENTS

EP 0533325 A1 3/1993

(Continued)

*Primary Examiner* — Nimeshkumar Patel
*Assistant Examiner* — Mary Ellen Bowman
(74) *Attorney, Agent, or Firm* — Mark L. Beloborodov

(57) ABSTRACT

A method for manufacturing a discharge lamp comprising at least two tubes or bulbs is disclosed. The lamp is especially a high intensity discharge lamp for use for example in a head lamp of a vehicle, and comprises an inner tube or bulb for enclosing an arc discharge chamber and an outer tube or bulb (30) for sealingly enclosing the inner tube or bulb, wherein the inner volume of the outer tube or bulb (30) is evacuated or filled with a gas in an easy and reliable way by using at least one two-step pinching and/or roll-on process for fixation of both tubes at least at one of their axial ends, wherein in a first step the fixation is carried out in such a way that a passage (20) remains that runs in an at least substantially axial direction of the lamp between the inner volume of the outer tube (30) and the outside of the axial end (8) of the inner tube or bulb through which passage the inner volume is evacuated and/or filled with a gas, and wherein in a second step the passage is sealingly closed by carrying out a second pinching or roll-on process.

8 Claims, 2 Drawing Sheets

U.S. PATENT DOCUMENTS

Figure 1:
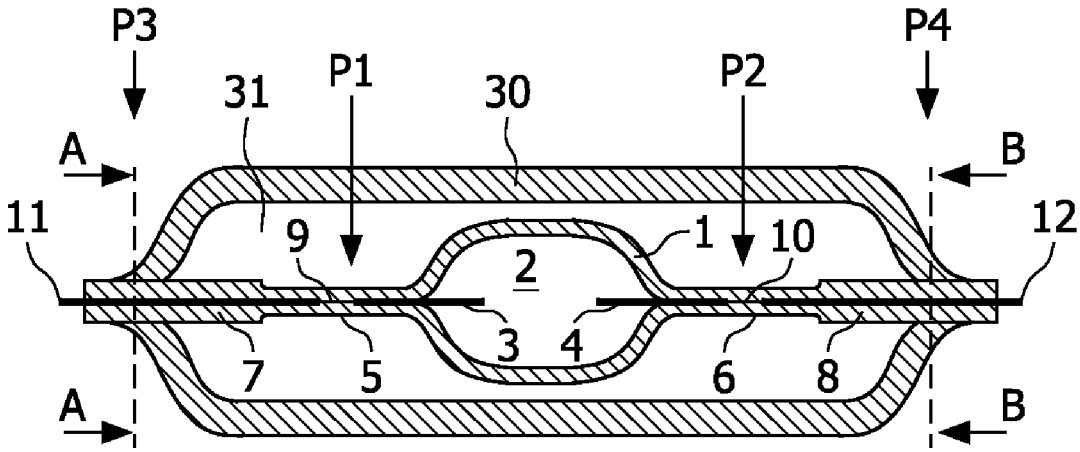

| | | | |
|---|---|---|---|
| 2003/0048052 | A1 | 3/2003 | Kubon et al. |
| 2004/0253897 | A1 | 12/2004 | Graf et al. |
| 2004/0256986 | A1 | 12/2004 | Graf et al. |
| 2006/0061284 | A1 | 3/2006 | Nishibori |

FOREIGN PATENT DOCUMENTS

| | | | |
|---|---|---|---|
| GB | 1298397 | A | 11/1972 |
| JP | 56158202 | A | 12/1981 |

* cited by examiner

METHOD FOR MANUFACTURING A DOUBLE TUBE DISCHARGE LAMP

The invention relates to a method for manufacturing a discharge lamp, especially a high intensity discharge lamp and especially for use in automotive head lamps, comprising at least a first inner tube (or bulb) for enclosing a discharge chamber (discharge vessel) and a second outer tube (or bulb), which sealingly encloses an inner volume and the first inner tube, wherein the inner volume of the second outer tube is evacuated or filled with a gas.

Providing a double tube discharge lamp may have several advantages or reasons. Apart from a thermal insulation of the inner bulb enclosing the discharge gas, by which the efficiency of the lamp can be improved, the outer bulb can mechanically protect the inner bulb and can prevent that contaminations from the surroundings reach the hot regions of the inner bulb (burner). Another purpose of the outer bulb can be the filtering of the emitted radiation, e.g. in order to protect the surroundings of the lamp against UV radiation especially if there are synthetic or other UV sensitive materials.

Especially in such lamps for automotive use, the inner volume of the second outer tube is filled with a gas (or air). However, due to the process of heating and closing the outer tube during manufacturing of the lamp, this gas may contain a considerable amount of water vapor. Furthermore, the pressure of the gas is not defined since it depends on the settings of the heating processes. Both these facts are considered detrimental and may lead to additional spread in lamp characteristics as e.g. maintenance, luminous flux, etc. Consequently, it is desired to control the composition as well as the pressure of the gas filling within the outer tube.

US 2004/0253897A1 discloses a method for manufacturing a double tube discharge lamp in which a transversal pumping hole is generated by means of a laser into a sleeve like extension part which continues an axial sealing part of the inner tube. The outer tube of the lamp is fixed by means of a suitably shaped roll at the extension part comprising the pumping hole in such a way that this hole remains open into the space between the outer and the inner tube. By means of a pumping and filling system that is fitted onto the axial open end of the sleeve like extension part, the atmosphere between the outer and the inner tube can be pumped out via the pumping hole and the inner volume of the extension part. After this, the pumping hole is closed for example by another heating and rolling process or by a material that drops into the hole after local heating with reduced pressure.

However, providing a sleeve like extension part and generating a transversal pumping hole into it in the vicinity of the adjacent sealing part of the inner tube is considered disadvantageous because this induces the risk of damage of the extension part and/or the sealing part e.g. by fractures due to excessive local temperature differences when generating the hole.

An object underlying the invention is to provide a method for manufacturing a double tube discharge lamp as mentioned above which can be carried out in an easier way and/or with a considerably reduced risk of damaging parts of the lamp.

Furthermore, a method for manufacturing a double tube discharge lamp as mentioned above should be provided which enables an effective and easy filling and closing process of the outer tube.

The object is solved according to claim 1 by a method for manufacturing a discharge lamp comprising at least a first inner tube and a second outer tube, which encloses an inner volume and the inner tube, wherein the method comprises at least one two-step pinching and/or roll-on process for fixation of both tubes at least at one of their axial ends, wherein in a first step the fixation is carried out in such a way that a passage remains that runs in an at least substantially axial direction of the lamp between the inner volume of the second outer tube and the outside of the lamp, through which passage the inner volume is evacuated and/or filled with a gas, and wherein in a second step the passage is sealingly closed by carrying out a second pinching or roll-on process.

This method has the advantage that no extra hole has to be generated in any parts of the lamp so that the risk of damage of the lamp by generating such a hole is accordingly removed. Furthermore, a simple way to fill the outer tube with a required gas mixture is enabled as well.

The sub claims disclose advantageous embodiments of the invention.

Claims 2 to 5 disclose how the first and second steps are advantageously carried out.

Claim 6 relates to an advantageous step of filling the inner volume of the outer tube.

Claims 7 and 8 disclose advantageous steps for closing the passage.

The invention further relates to a discharge lamp comprising at least a first inner tube and a second outer tube, which encloses an inner volume and the inner tube, the discharge lamp manufactured by a method according to the invention.

In a further embodiment, the invention also relates to pinching or roll-on blocks for carrying out a pinching or roll-on process, the pinching or roll-on blocks comprising an opening that extends with its area asymmetrically into the halves of the pinching or roll-on blocks, the pinching or roll-on blocks especially for use in a method according to the invention.

Figure 2:
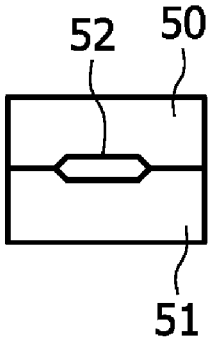
Figure 3:
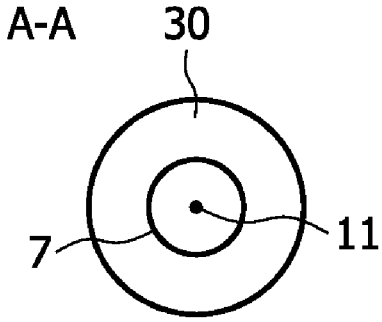
Figure 4:
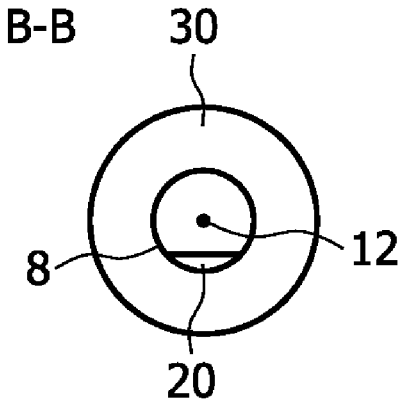
Figure 5:
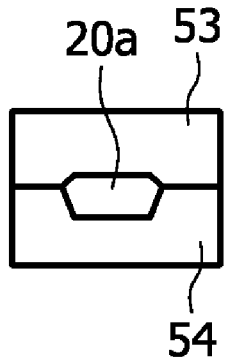
Figure 6:
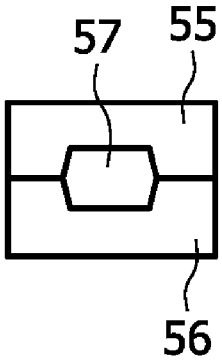

Further details, features and advantages of the invention become obvious from the following description of a preferred and exemplary embodiment of the invention in connection with the drawings in which shows:

FIG. 1 a schematic longitudinal section through main parts of a double tube discharge lamp;

FIG. 2 a schematic cross section through prior art pinching blocks;

FIG. 3 a cross-section through a first axial end of the double tube discharge lamp;

FIG. 4 a cross-section through a second axial end of the double tube discharge lamp;

FIG. 5 a schematic cross section through first pinching blocks according to the invention; and FIG. 6 a schematic cross section through second pinching blocks according to the invention.

FIG. 1 schematically shows a longitudinal section through main parts of a double tube discharge lamp comprising a first inner tube 1 and a second outer tube 30, which encloses the first inner tube 1.

The first inner tube 1 encloses a discharge chamber 2, which comprises a discharge gas. Between the opposing ends of a first and a second electrode 3, 4, which extend into the discharge chamber, a gas discharge arc is excited.

The second outer tube 30 sealingly encloses an inner volume 31, which is preferably filled with a gas or dry air, or the inner volume 31 is evacuated. Furthermore, the second outer tube 30 encloses the first inner tube 1, as well as a first and a second axial sealing part 5, 6 of the first inner tube 1 and a first and a second axial extension part 7, 8 which each axially continue the first and the second sealing part 5, 6, respectively, through the inner volume 31 of the second outer tube 30 to the outside of the lamp.

The first and the second electrode 3, 4 extends through the first and second sealing part 5, 6, respectively, and is connected via a first and a second foil 9, 10 to a first and a second conductor 11, 12, respectively, which are fed through the first and the second extension part 7, 8, respectively, to the outside of the lamp for being connected with an external power supply (not indicated) in a known manner.

When manufacturing such a lamp, the first inner tube 1 is prepared by heating and pinching processes and/or heating and roll-on processes in order to sealingly close the first inner tube 1 at both axial ends and to connect the electrodes 3, 4 within the sealing parts 5, 6 via the foils 9, 10 to the conductors 11, 12, respectively. Related pinching blocks 50, 51 enclosing a longitudinal opening 52 are schematically shown in cross section in FIG. 2, by which a first and a second pinching (or roll-on) area P1, P2 at the sealing parts 5, 6, respectively, is obtained with a corresponding flat cross section.

Then the first inner tube 1 is introduced into the second outer tube 30 having appropriate form and dimensions (e.g. a cylinder) and comprising a first and a second axial end.

At a first axial end of the lamp, a first end of the second outer tube 30 is sealingly fastened at the first extension part 7 of the inner tube 1 by another heating and pinching process and/or by a heating and roll-on process for obtaining a third pinching or roll-on area P3 in a known manner. FIG. 3 schematically shows a cross section along the line A-A in FIG. 1 which indicates that the first end of the second outer tube 30 sealingly encloses the first extension part 7 through which the first conductor 11 extends to the outside of the lamp.

At the opposite second axial end of the lamp, the second end of the second outer tube 30 is sealingly fastened at the second extension part 8 by a heating and pinching process and/or by a heating and roll-on process which is carried out at a fourth pinching or roll-on area P4 in two subsequent steps.

In a first such step, the fastening or a fixation is carried out such that a passage or hole 20 between the second end of the second outer tube 30 and the second extension part 8 remains open and extends in an at least substantial axial direction from the outside of the lamp into the inner volume 31.

This hole 20 is indicated schematically in FIG. 4 in cross section along the line B-B in FIG. 1 (in which the hole 20 is not shown), and has e.g. the form of a flat section. The hole 20 is preferably generated by a roll-on process which is carried out by means of first modified or extended pinching blocks 53, 54 enclosing an opening 20*a* which is asymmetrically extended with respect to the halves of the first pinching blocks as schematically shown in cross section in FIG. 5, so that by roll-on, the first pinching blocks 53, 54 do not completely close the second end of the second outer tube 30 around the second extension part 8 but leave the hole 20 between both open.

In order to achieve this, the first pinching blocks are formed such that the opening 20*a* is asymmetrically introduced with respect to its area into a first and a second half 53, 54 of the first pinching blocks. As indicated in FIG. 5, the first half 53 comprises a smaller area of the opening 20*a* than the second half 54.

Preferably, first pinching blocks 53, 54 are used which have an opening such that an overall at least substantially circular cross-section of the fourth pinching area P4 is obtained according to FIG. 4.

The cross sectional form of the opening 20*a* is preferably selected in dependence on the cross section of the second extension part 8 in order to obtain a desired form and dimension of the cross section of the hole 20. Especially if the second extension part 8 has been formed or pre-formed by the heating and pinching process and/or by the heating and roll-on process of the adjacent second sealing part 6, a desired form and dimension of the cross section of the hole 20 can be reliably obtained.

Subsequently, the inner volume 31 can be evacuated and for example filled with a desired gas mixture or preferably dry air through the hole 20.

In order to achieve this, the lamp is preferably introduced into a sluice. By evacuating the sluice, also the inner volume 31 of the outer tube 30 is evacuated. Then the lamp is transferred from the sluice to a chamber containing the desired gas mixture at a defined pressure, so that the gas enters the inner volume 31 of the outer tube 30. To maintain the gas mixture and its pressure in the inner volume 31 of the outer tube 30, the lamp is preferably maintained within the chamber until the hole 20 is closed. Within this chamber, the outer tube 30 is now completely closed by the second step of the heating and pinching process and/or by the heating and roll-on process.

With this second step, the hole 20 is sealingly closed preferably by a roll-on process which is carried out by means of second pinching blocks 55, 56 (especially a usual roll-on equipment which has been used for the pinching process and/or roll-on process at the third pinching or roll-on area P3) having an opening 57 as schematically shown in cross section in FIG. 6, so that by local heating and roll-on (or heating and pinching), the second end of the second outer tube 30 is completely closed around the second extension part 8 in such a manner that the hole 20 is sealingly closed as well, so that the fourth pinching or roll-on area P4 is completed.

The settings for this second step are preferably adapted in such a way that only the amount of energy is fed to the roll-on area which is sufficient to close the hole 20 but which does not increases the temperature of the lamp beyond a minimum value. In order to achieve this, preferably a laser or plasma burner is used as the heat source for this second step.

The invention claimed is:

1. A method for manufacturing a discharge lamp comprising at least a first inner tube and a second outer tube, which encloses an inner volume and the inner tube, wherein the method further includes:

at least one two-step pinching and/or roll-on process for fixation of both tubes at least at one of their axial ends, wherein in a first step the fixation is carried out in such a way that a passage is formed that runs in an at least substantially axial direction of the lamp between the inner volume of the second outer tube and the outside of the lamp, through which passage the inner volume is evacuated and/or filled with a gas, wherein the first step forming said passage is carried out by means of first pinching or roll-on blocks enclosing an opening that extends with its area asymmetrically or symmetrically into halves of the blocks providing room for formation of said passage between said second outer tube and said first inner tube, and wherein in a second step the passage is sealingly closed by carrying out a second pinching or roll-on process.

2. A method according to claim 1, wherein the first step is a pinching process.

3. A method according to claim 1, wherein the second step is a roll-on process.

4. A method according to claim 1, wherein after the first step the lamp is introduced into a chamber for evacuating the inner volume and/or for filling the inner volume with a gas and for carrying out the second step for closing the passage.

5. A method according to claim 1, wherein in the second step heat is applied to the roll-on area only to such an extent as is required for reliably closing the passage.

6. A method according to claim 5, wherein the heat is applied by means of a laser or plasma burner.

7. A method for manufacturing a discharge lamp, comprising:

sealing a first and second end of an inner tube within an electrode extending from said first and second end of said inner tube;

wherein said first end of said inner tube extends into a first extension, said second end of said inner tube extends into a second extension;

positioning said inner tube within an outer tube, wherein said outer tube encloses said inner tube and a volume around said inner tube;

sealing said first extension with said first end of said inner tube contained therein with a first end of said outer tube;

fixing of a second end of said outer tube with said second extension with said second end of said inner tube container therein, maintaining a passage running in an at least substantially axial direction of said discharge lamp between said volume of said outer tube and the outside of said lamp through which passage said inner volume is evacuated and/or filled with a gas;

wherein said maintaining step is implemented by a first pinching or roll-on blocks enclosing an opening that extends with its area asymmetrically or symmetrically into halves of the blocks; and sealing said passage closed by carrying out a second pinching or roll-on process.

8. A method of forming a discharge lamp, comprising:

sealing a first and second end of an inner tube having an electrode extending outward from each of said first end and said second end;

inserting said first end of said inner tube into a first end of an outer tube;

sealing said first end of said outer tube with said first end of said inner tube such that said electrode is accessible;

fastening said second end of said inner tube with said electrode into a second end of said outer tube;

forming a passage between said second end of said outer tube and said second end of said inner tube by use of modified pinching blocks, said modified pinching blocks enclosing an opening which is asymmetrically extended with respect to said blocks;

wherein said pinching blocks do not completely close said second end of said outer tube thereby leaving said passage;

evacuating an inner volume of said outer tube through said passage formed in said second end of said outer tube;

sealing said second end of said outer tube around said second end of said inner tube to sealingly close said passage.

* * * * *